US005105894A

United States Patent [19]

Enderlin

[11] Patent Number: 5,105,894

[45] Date of Patent: Apr. 21, 1992

[54] METHOD AND APPARATUS FOR ORIENTATING CORE SAMPLE AND PLUG REMOVED FROM SIDEWALL OF A BOREHOLE RELATIVE TO A WELL AND FORMATIONS PENETRATED BY THE BOREHOLE

[75] Inventor: Milton B. Enderlin, Arlington, Tex.

[73] Assignee: Halliburton Logging Services, Inc., Houston, Tex.

[21] Appl. No.: 647,941

[22] Filed: Jan. 30, 1991

[51] Int. Cl.[5] ..... E21B 25/16; E21B 47/026; E21B 49/02

[52] U.S. Cl. ..... 175/44; 166/255; 324/350; 324/351

[58] Field of Search ..... 175/44, 45, 58, 59, 175/60; 166/255, 254; 324/346, 348-351; 73/151, 382 R

[56] References Cited

U.S. PATENT DOCUMENTS 2,628,816 2/1953 Mahan ..... 175/44 X
2,810,548 10/1957 Martinez ..... 175/44
3,241,623 3/1966 Martinez ..... 175/4 X
3,324,563 6/1967 DeGast ..... 175/44 X
4,955,438 9/1990 Juergens et al. ..... 175/45 X
5,014,008 5/1991 Flowerdew ..... 175/45 X

*Primary Examiner*—Stephen J. Novosed
*Attorney, Agent, or Firm*—William J. Beard

[57] ABSTRACT

A method and apparatus for determining the location in space of a formation sample is set forth. This involves a tool which is typically run on a wireline in a well, the tool supporting orthogonal positioned magnetometers and similar orthogonal accelerometers for measuring movement of the tool along the well borehole whereby components of the magnetic field and gravity field are measured to enable determination of the well in space. The tool supports an axially positioned centrally located core cutting apparatus and a laterally projecting plug cutting apparatus; scribe marks formed on the formation samples orient the samples relative to the tool and the tool is located in space from the above mentioned measurements so that the position of formation samples can be determined.

18 Claims, 1 Drawing Sheet

METHOD AND APPARATUS FOR ORIENTATING CORE SAMPLE AND PLUG REMOVED FROM SIDEWALL OF A BOREHOLE RELATIVE TO A WELL AND FORMATIONS PENETRATED BY THE BOREHOLE

BACKGROUND OF THE DISCLOSURE

Those familiar with the drilling of oil and gas wells will appreciate the fact that a well is not necessarily precisely vertical at most points along the depth of the well. In like fashion, they appreciate the further fact that the earth, while formed of multiple layers, nevertheless may be formed of numerous layers at different angles with respect to the surface. To be sure, many wells are drilled that are substantially vertical, i.e. they are within two or three degrees of vertical as determined by a plumb bob or, stated in more elegant language, with respect to the gravity vector. There are many wells which are drilled where the well borehole may pass through formations of interest which are relatively well known and for which additional data is not required to enable well completion. Just as this is possible at one extreme, the opposite extreme of well position relative to the formations might occur. As an example, consider a highly deviated well which is drilled from an offshore platform where fifty or more wells extend from the platform, and very few of these can be described as simple vertical wells. Any number of the wells might deviate substantially from the vertical so that the well borehole has a portion which is perhaps vertical, another portion which is inclined at 60° with respect to the vertical, another portion which is substantially vertical and so on. Indeed, there can even be a portion which is substantially horizontal to obtain large production flow rates from a relatively thin formation. Moreover, the well may intercept numerous formations of random thickness and having a variety of angular orientations. In that context, data obtained from the well must be oriented in space relative to the track or path of the well borehole and the formations penetrated thereby so that it is difficult to know what formations are implicated by the data. This is especially true for samples which are obtained from the formations.

There are three types of samples of interest to the present disclosure. The first is a core which is usually cut by a core bit while making the well borehole. That is, a cylindrical sample is cut by a cutting bit and then is removed with the bit by retrieving the hollow core storage device. This core is removed to advance the well depth. This will be described hereinafter as a conventional core sample or core. A second type of retrieved material is a cylindrical sample cut from and at right angles to the long axis of the conventional core. This sample will be called a core plug. The third type of retrieved material is a plug formed by a plug forming apparatus which is the device often known as a rotary sidewall coring tool which provides the much smaller plug sample. This particular device operates at right angles to the well borehole axis to remove a sample from the sidewall. Normally, this sample (a plug) is smaller in diameter and length than the core. It will described hereinafter as a plug. Where no distinction is required, both will jointly be described as a formation sample or simply as a sample. Samples are important in determining how to complete a well. A sample may be essential to determine whether or not a well should be plugged and abandoned or the further expense of completion should be incurred, that is, casing the well and forming perforations through the casing into the formations of interest. It is extremely important to know where the particular formation sample was obtained. Data of substantial importance can be obtained from the formations. In some instances, but certainly not all instances, the formations may be monolithic and devoid of information which is directional in nature. A more sophisticated description of earth formations may focus on this particular aspect. Similar to a tree which has a grain direction and inherent differences in characteristics with respect to direction, such differences in strength across or with the grain in like fashion point out formation directional characteristics. There may be directional differences in permeability, and it may desirable to also conduct directional petrographic studies. The formation sample many be subjected to directional examination under a scanning electron microscope. The formation may be formed of crystalline material which will then provide a different response with direction of irradiation when subjected to x-ray spectrometric studies. There may be a crystalline structure which defines a preferred fracture direction or stress direction. Because of these possible directional factors, it is important to know the position in space of a formation sample, and that includes both core and plug samples.

It has been difficult to obtain this information heretofore in highly deviated wells or in situations where the formations are suspected of departure from the rather simplistic model of parallel layers along the vertical borehole. By contrast, a relatively shallow well which is almost vertical relative to the gravity vector and which passes through a number of known formations (e.g., drilling a production well in a field that has been well explored) does not pose many problems. However, in a deviated well or a well near an upthrust of fracture in the region, the formation sample orientation is ideally determined by the mehtod and apparatus of the present disclosure so that the sample can be understood in context of its origination to thereby properly orient the sample data. This for instance enables determination of the imprinted paleomagnetic vector from formation samples. It enables determination of other data with respect to the location of the well borehole and the formations so that laboratory data obtained from formation samples can be meaningfully positioned in space. The present method and apparatus are directed to a system of determining the position of the tool comprising the cutting equipment which forms the formation sample. The tool is thus tracked in space and data regarding the position of the tool is processed so that the pathway of the well borehole can be determined. This data tracks or follows the locus of the borehole. The formation sample cutting device is thus positioned in space relative to the formations, and the core or plug is then obtained. This then enables the formation sample to be subsequentially retrieved to the surface so that the formation sample can be oriented and the test data obtained from the sample then is evaluated and the data can then be positioned in space to be much more helpful to well completion procedures.

DETAIL DESCRIPTION OF THE PREFERRED EMBODIMENT

Figures 1, 2:
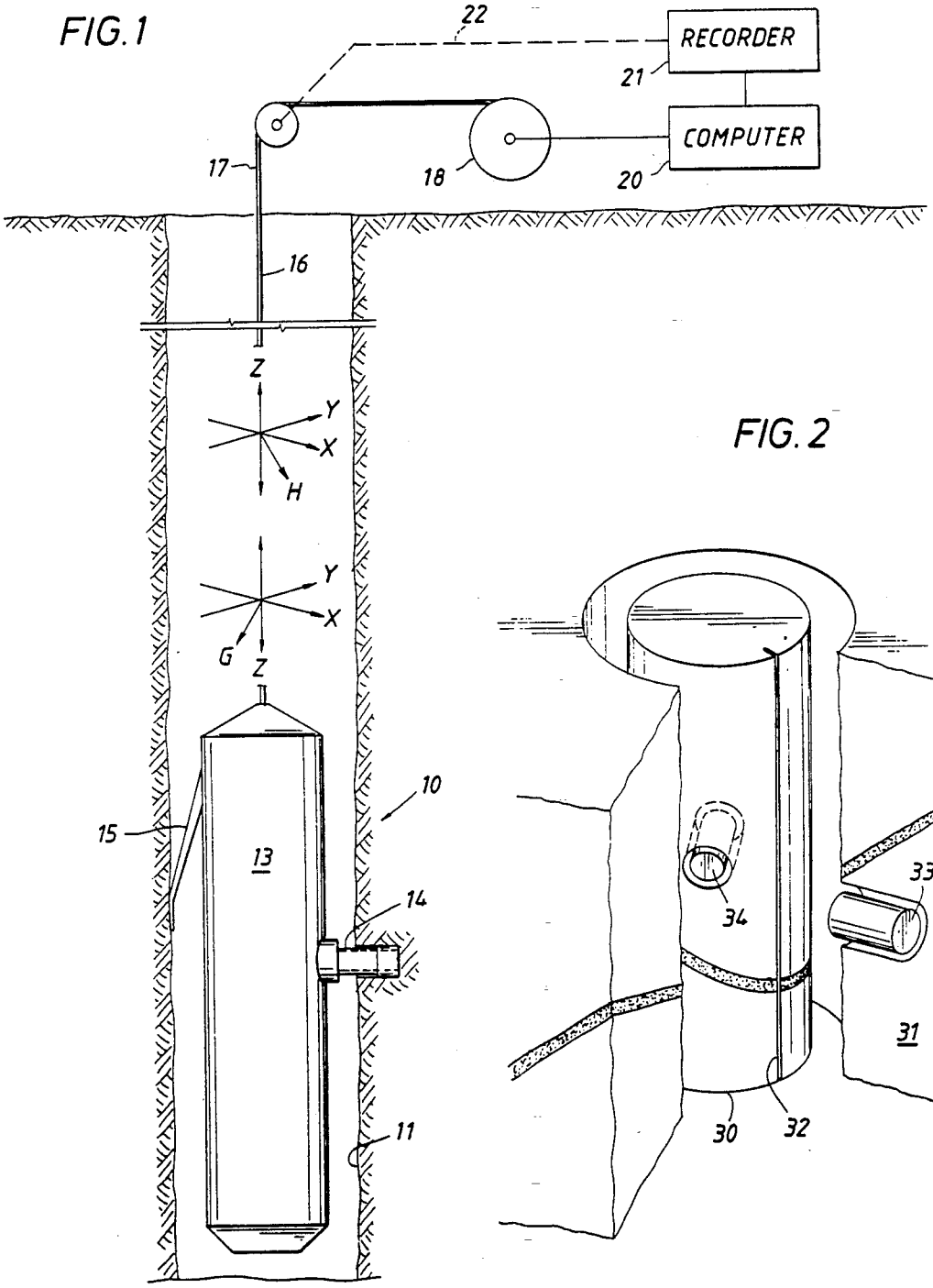
FIG. 1 shows a well borehole made while forming and removing a sample known as a core, and shows the next step positioning a formation sample tool to obtain a plug, and further including apparatus for determining the location or whereabouts of the formation sample so that subsequential analysis can be meaningfully oriented in space.
FIG. 2 is a perspective view in space showing a core from a formation of interest, and further showing two smaller plugs from that formation, one plug cut from the core and one plug cut from the sidewall of the borehole.

Attention is first directed to FIG. 1 of the drawings where the numeral 10 identifies apparatus constructed in accordance with the present disclosure. The apparatus shown in FIG. 1 is shown in an open well borehole 11. A core cutting bit and attached drill stem is normally used to drill the borehole 11 and capture a sample, namely a core of some length and diameter. The core, along with the core bit and connected drill stem, is retrieved to clear the borehole 11 of the equiment. Typically, the core sample diameter is determined by the bit in the well borehole so that typical core sample diameters vary with the bit. The core sample that is cut can have any suitable length, and lengths are typically in the range of up to perhaps 60 feet. Then, the core is removed and the next step involves placing the next tool in the borehole. The housing 13 encloses and supports a rotary sidewall coring tool (RSCT) which drills laterally into the sidewall to obtain a smaller formation sample which will be called a plug. This uses an extended cutter tool 14. It is believed that the plug cutting tool is well known in the art, and they need not be described any further. Typically, the tool 14 can be operated with an internally located power source such as an electric motor in the housing 13. Typically, the housing 13 is held stationary during the process of obtaining a plug, and to this end, an arm 15 is extended so that the arm can hold the housing in a fixed location while the formation sample is being obtained from the sidewall.

The housing 13 additionally encloses and supports three accelerometers and three magnetometers. These provide output data which defines the gravity and magnetic field vectors in three resolved components which are represented by the symbols G and H respectively and vector components are represented by the appropriate subscripts $G_x$ or $H_x$. The three vectors are measured in form of the three components for further analysis and processing to determine the position of the well borehole in space so that the formation samples can be oriented. To make this more clear, FIG. 1 further shows the three coordinate system necessary to define components of the two vectors. The six components are thus output through a telemetry system in the housing 13 and are provided to the surface by transfer up a logging cable 16. The cable 16 passes over a sheave 17 and is stored on or supplied from a reel or drum 18. The cable includes sufficient conductors that the data is output to a surface located CPU 20, and the data is output to a recorder 21. A mechanical or electrical depth measuring apparatus 22 is connected with the sheave 17 for providing depth measurements. These depth measurements are output to the recorder so that the data obtained can be correlated to depth measured by cable. This provides a direct recording and indication of depth. Separate from this direct mode of determining depth, depth can also be determined in another fashion as will be mentioned.

Additional important information can be obtained from charts or graphs regarding the position of the earth's magnetic field. It is somewhat simplistic to say the earth's magnetic field is oriented with respect to the North Pole of the earth. There is of course some deviation from this placement. The regional magnetic field is actually determined with respect to the magnetic North Pole which deviates slightly from the geographic location of the North Pole. In addition, there are local magnetic field variations. These can be determined from charts which set forth this data. Thus, the ambient magnetic field vector found at a particular location is known in advance with a high degree of certainty. In any event, the magnetic field in the region of the well is determined from some source and represents a first data which is an important factor in determining the location of the well borehole in space, and to further orient the position of formation samples which are obtained thereafter. The present apparatus is preferably positioned in the well with substantial spacing from drill collars or drill pipe normally made of ferromagnetic materials. Indeed, the housing 13 can be lowered on a wireline in most instances and is operated by providing electrical power to the equipment. Alternately, it can be lowered on a drill string but this is not as desirable because of possible magnetic interferences. If a drill string is used, it is desirable however that the lower several feet of the drill string be formed of materials which do not create magnetic field disturbances. There are suitable alloys available for this purpose, namely alloys which do not create substantial magnetic field disturbances. Brass and aluminum are examples. In any event, the present system is operated to determine the angular orientation in space of the well borehole with respect to the formations of the Earth which are penetrated thereby.

As the tool 13 is lowered in the well borehole, the accelerometers provide a continuous output; that is, they measure tool movement by providing the three outputs signals which are $G_x$, $G_y$, and $G_z$. Therefore, as the tool housing 13 is moved from the well head to the very bottom of the well, continuous recording of the three output signals enables one to determine the path or trajectory of the well borehole in space. It is desirable to additionally obtain the magnetic measurements of the magnetic field so that the three signals ($H_x$, $H_y$, and $H_z$) are likewise output and recorded. This data is recorded and analyzed so that the pathway of the well borehole can be determined. It is possible to determine the borehole location only with the gravity data. It is however desirable to include the magnetic field data which further enhances the accuracy of the data which is obtained. Data measurements are telemetered from the housing 13 during movement from the well head to the bottom of the well. This enables such a determination to be made. Moreover, by plotting the trajectory or locus of the borehole, the direction of the borehole 11 at the very bottom can then be determined. That is to say, the data represents the pathway of the well borehole or trajectory to the bottom, and given the fact that the housing has affixed length and is a straight cylindrical structure, the actual location of the bottom of the well borehole 11 can then be determined with respect to geographic north and the horizon.

The core aligned with the borehole as it is cut by the core bit is received into a hollow cylindrical sleeve. The sleeve includes one or more sharp points which scratch the core with a scratch or scribe mark along the length of the core so that the core can be pieced together. If a core of 30 feet is cut from three formations, the core may break into pieces at a weak place, or may separate into separate portions at a sand layer. The assembled bits of core are shown as one piece in FIG. 2 where adjacent core pieces are aligned relative to each other. It will be appreciated that, prior to cutting, the core is fixed in an unknown location while it is a portion of the formation of interest. As represented in FIG. 1 of the drawings, assume that the well borehole 11 is at an angle with respect to the vertical. Further assume it is at a different angle with respect to the magnetic field. It is possible through the method of the present disclosure to determine the precise position of the full length of the housing 13, and in particular the plug cutting tool 14. As mentioned, the conventional core is scratched with a mark which serves as a reference mark on the core when retrieved to the surface and when subsequently tested. Consider as an easy example the circumstances in whch the well 11 of FIG. 1 is approximately vertical. Assume further that the core (one or several sections) is oriented by a reference scribing instrument when it is cut. Assume further that the scribe mark shown in FIG. 2 on the core was made at the north azimuth or 0°. In that instance, with the core retrieved to the surface, the location of the scribe mark assists in positioning the core segments as one in space and later in space with respect to the surrounding formations. The relative angle of the core sample with respect to the formation is later identified. It is possible to determine all three angles in space defining the core in space. The core is thus located by the angles $C_\alpha$, $C_\beta$, and $C_\gamma$. In like fashion, the plug which is obtained from the sidewall by the apparatus 14 is located in space indicated by the angles $P_\alpha$, $P_\beta$, and $P_\gamma$.

The manner determining positions in space is perhaps better understood by referring to FIG. 2 of the drawings. There, the numeral 30 identifies a core previously cut from a formation 31. The core 31 is obtained by a conventional core cutting bit in the conventional fashion, and the pieces (one or several) are aligned to the length wise scratch or mark 32. At this juncture, the location of the scribe mark 32 in azimuth is not initially known. The position in space for the plug 33 cut from the sidewall of the formation is known. At the surface, it is possible to cut a core plug 34 from the core 30. The core plug 34 is cut along a radial line with respect to the core. After the plug is cut form the core, its position in space with respect to the core is marked and known. The plug 33 may be cut in the formation 31 at an azimuth of 45°. The second plug 34 cut from the core will have an azimuth measured relative to the scribe mark 32. These two plugs have an unknown included angle with respect to each other. Any small vertical offset between the plugs 33 and 34 along the core is not material so long as the two plugs have the common grain directional characteristics. The linking factor in positioning the core relative to the formation include is the imprinted remnant paleomagnetic vector in the two plug samples 33 and 34. Recall that the azimuthal position of the plug 33 is known, and the paleomagnetic vector of the plug 33 is measured. Since the paleomagnetic vector of the core plug can be measured and is in the same direction as the paleomagnetic vector of the plug 33, the azimuthal position of the scribe mark 32 and position of the core 30 can then easily be determined. Geographic north is determined from magnetic north plus the localized magnetic field deviation.

A typical operating procedure involves the following steps. After a well has been drilled to a specified depth, the drill string and core bit with core is removed from the well and the apparatus 13 shown in FIG. 1 is placed in the well. Typically it is lowered in the well on a cable or wireline which includes one or more conductors for transfer of the data of interest. Readings of G and H are taken at the well head when the equipment is first placed in the well. This provides a beginning point for the data. As the housing 13 is lowered in the well, readings are obtained from all the sensors, namely six data are obtained from the six sensors. In addition to that, the cable that is spooled over the sheave 17 is measured to locate the tool 13 in the well borehole. The tool 13 travels along the well to the bottom of the well. When it arrives at the bottom, movement then stops, and the tool location in space is determined. As it were, this forms a plot or trajectory in space describing the path of the well borehole. Moreover, a data comparison is provided, namely a comparison between the calculated depth of the well using the six variables measured by instruments on the housing 13 and depth measured from the cable movement at the surface. It is assumed that there is no significant ferromagnetic material in the near vicinity of the sensors. It is assumed that the well is not cased near the lower end of the well. At bottom, the arm 15 is extended to lock the housing in place. By power from an electric motor, the plug is obtained from the sidewall of the borehole by extending the apparatus 14 to cut the small plug 33. The normal breaking action of the apparatus 14 puts a scrape mark on the distant or formation end of the plug 33. The scrape mark indicates the "tops" of the plug 33 with respect to a plane normal to the axis of the well borehole 11. The plug is also held in the equipment and is retrieved with the equipment when it is pulled back to the surface.

The relative position of the plug 33 with respect to the locus or trajectory of the borehole is then determined from the data. Knowing the plug 33 "tops" fixes the position in space of the plug 33, and the precise location of the core 33 with respect to the open hole 11 is determined. The plug cutting means 14 can operate along the X or Y axes, as an easy example, so that positioning of the plug is easily established with respect to the several sensors.

By testing the plugs 33 and 34 for their paleomagnetic vectors, the included angle between the plugs 33 and 34 can be measured. Each plug is measured to determine the paleomagnetic vector. Both plugs extend as radial lines from the axis of the well borehole 11; since the azimuthal position of the plug 33 is known, the core 30 can be rotated around its long axis until the paleomagnetic vector of core plug 34 is in the same direction as the paleomagnetic vector of the plug 33. The azimuthal position of the scribe mark 32 can then easily be determined.

What is claimed is:

1. A method of determining the position in space of a formation sample comprising the steps of:

(a) moving sensors from the surface via a wireline cable along a well borehole from the well head to a specified depth in a well wherein the movement along the well is sensed by determining gravity or magnetic field measurements during movement and the gravity or magnetic field measurements are resolved into coordinate components;

(b) from the coordinate components, determining the location of the tool along the well borehole; and (c) cutting a formation core sample at that location wherein the relative position of the sample with respect to the tool is known so that the location of the tool determined with the measurements as the tool moves along the well borehole provides a description in three variables of the formation sample in space with respect to the well borehole.

2. The method of claim 1 wherein a core sample is cut from the well borehole at the bottom thereof.

3. The method of claim 1 wherein measurements derived from the gravity or magnetic sensors provide an indication of well depth.

4. The method of claim 1 wherein cable length extending from the surface measures the well depth of the tool.

5. The method of claim 1 wherein well depth of the tool is measured by at least two alternate techniques one of which is cable length extending from the surface to provide data for comparison.

6. The method of claim 1 wherein a core is cut from the formation axially extending along the well borehole, and is moved to the surface along the well borehole;

a radial plug is cut from the sidewall of the well borehole at a depth to obtain a sample from formations adjacent to the core cut from the formation; and comparing the radial plug cut from the sidewall to the core to obtain information about the formation from which the plug was cut.

7. The method of claim 6 including the step of determining angular orientation of the plug to the core to position the core relative to the formation from which the plug was cut.

8. The method of claim 6 wherin said plug and core are tested for directional characteristics to obtain a position for the core relative to the formation.

9. The method of claim 6 wherein a similar plug is cut radially from the core, and is compared in directional characteristics to determine the position in space of said core.

10. The method of claim 9 wherein said core is plugged to obtain an oriented plug for comparison with radial plug.

11. The method of claim 10 wherein said oriented plug and said radial plug are tested for paleomagnetic vector direction.

12. The method of claim 11 wherein both of said plugs are obtained at radial lines relative to the axis of the well borehole.

13. The method of claim 12 wherein both of said plugs are measured for angular position relative to a set of three orthogonal coordinate axes.

14. The method of claim 1 wherein acceleration in three orthogonal coordinate axes is measured in a coordinate system defined by gravity on moving sensors along a well borehole.

15. The method of claim 14 wherein three orthogonal magnetic field sensors measure the magnetic field components of the earth along the well borehole.

16. An apparatus for determining the location in a well borehole of a sample obtained from a formation along the well borehole comprising:

(a) sample cutting means suspended by a wireline cable in a well borehole and having an elongate housing and including cylindrical sample receiving means; and (b) gravity sensor means mounted for movement with said housing, said gravity sensor means measuring acceleration movement of said housing as said housing moves along a well borehole from a well head toward the bottom of a well borehole, said sensor means forming a gravity vector signal providing the location of the well borehole in space defined by three orthogonal coordinate dimensions.

17. The method of claim 16 wherein said housing is connected to a flexible cable means including conductors connected from said housing to provide signals at the well head providing the location of the well borehole in space.

18. The apparatus of claim 17 further including three orthogonal sensors for the magnetic field of the earth which sensors form three dimensions in space.

* * * * *